US005645679A

United States Patent [19]

Hansch

[11] Patent Number: 5,645,679

[45] Date of Patent: Jul. 8, 1997

[54] APPARATUS FOR FEEDING SHEET-LIKE PRODUCTS TO A PROCESSING DEVICE FOR PRINTED PRODUCTS

[75] Inventor: Egon Hansch, Wetzikon, Switzerland

[73] Assignee: Ferag AG, Switzerland

[21] Appl. No.: 409,792

[22] Filed: Mar. 23, 1995

[30] Foreign Application Priority Data

Mar. 24, 1994 [CH] Switzerland ..... 00887/94

[51] Int. Cl.[6] ..... B32B 31/00

[52] U.S. Cl. ..... 156/566; 156/568; 156/571; 156/DIG. 31; 271/271

[58] Field of Search ..... 156/566, 567, 156/568, DIG. 31, 571, 578; 271/271

[56] References Cited

U.S. PATENT DOCUMENTS

| | | | |
|---|---|---|---|
| 2,395,497 | 2/1946 | Nordquist . | |
| 4,279,412 | 7/1981 | Glatz . | |
| 4,981,291 | 1/1991 | Honegger et al. . | |
| 5,042,792 | 8/1991 | Honegger et al. . | |
| 5,052,666 | 10/1991 | Hansch . | |
| 5,052,667 | 10/1991 | Hansch . | |
| 5,112,430 | 5/1992 | Hudson | 156/568 X |
| 5,155,968 | 10/1992 | Mosse et al. . | |
| 5,275,685 | 1/1994 | Stauber . | |
| 5,292,110 | 3/1994 | Honegger . | |
| 5,324,014 | 6/1994 | Honegger et al. . | |
| 5,350,167 | 9/1994 | Hansch . | |
| 5,377,967 | 1/1995 | Eberle . | |

*Primary Examiner*—James Engel
*Attorney, Agent, or Firm*—Brinks Hofer Gilson & Lione

[57] ABSTRACT

The conveying device exhibits a plurality of clamps which are each articulated, via a carrying arm and a linking member, on rotational elements. The pivot position of the carrying arm is controlled by a first slotted-guide path and, separately from this, the position of the linking member is controlled by a second slotted-guide path. This permits pivoting of the clamps even independently of the movement of the carrying arms. The clamps can thus be controlled in an optimum manner for the respective purpose. In particular, it is possible, with constant speed of the rotational elements, to change the speed of the clamps and, at the same time, to control the direction of the clamps independently.

18 Claims, 6 Drawing Sheets

APPARATUS FOR FEEDING SHEET-LIKE PRODUCTS TO A PROCESSING DEVICE FOR PRINTED PRODUCTS

BACKGROUND OF THE INVENTION

The present invention relates to an apparatus for feeding sheet-like products to a processing device for printed products.

An apparatus of this type is disclosed in U.S. Pat. No. 5,350,167 and U.S. patent application Ser. No. 08/173967 and the corresponding EP-A-0606549 and EP-A-0606550. The disclosed device includes a rotationally driven, wheel-like carrying member. Clamps which can be controlled via pivot levers and links are arranged at intervals in the circumferential direction on the carrying member. The pivot levers and links are mounted on the carrying member, such that they can pivot about axes parallel to the axis of rotation. The position of the clamps is thus controlled, in the manner of a four-bar mechanism, depending on the pivot position of the pivot lever. If the pivot lever is pivoted toward the rear (as seen in the direction of rotation) the mouth of the clamp is directed toward the front. It assumes this position upon running through a receiving region in which it seizes a product at the product's trailing edge (as seen in the direction of rotation). The product is fed to the receiving region, by a belt conveyor, tangentially to the movement path of the clamps, but at a speed which is lower than the speed of the clamps. Upon pivoting the pivot lever out of its rearwardly directed end position into an approximately radial position, the clamp, in dependence on the movement of the pivot lever, is pivoted counter to the direction of rotation. This introduces the product into the transfer region between wall elements of a processing device for printed products. There the product is layed on a printed product which is butting against the wall elements. In order to ensure that the products are seized by the clamps in the receiving region, the products are always fed in the same direction as the direction of rotation, but at a relatively lower speed. In the arrangements disclosed in these documents, the receiving of products which are stopped, relative to the direction of rotation, in the receiving region is not mentioned. Nor is such receiving possible with the apparatus disclosed therein. Furthermore, only flexible products can be processed in the disclosed device.

Another apparatus for feeding sheet-like products to a processing device for printed products and for bonding the products onto the same is disclosed in U.S. Pat. No. 5,275,685 and the corresponding EP-A-0540865. The apparatus disclosed here includes a belt conveyor which feeds card-like products, spaced apart from one another, to a receiving region. The products are received there by means of flat retaining devices with suction heads or controlled grippers. In the receiving region these suction heads or control grippers move essentially in the same direction and at the same speed as the products to be received. The retaining devices are mounted on pivot levers which are articulated on a wheel-like, rotationally driven carrying member. Links are also articulated on the retaining devices. At the other end, these links, are also pivotably mounted on the carrying member and are coupled to a planetary gear mechanism in order to control the pivot position in dependence on the movement of the carrying member. In the receiving region, the retaining devices or grippers are directed approximately tangentially with respect to their rotational path. During the course of an approximately half-rotation of the carrying member, the retaining devices or grippers are pivoted, by the planetary gear mechanism, through approximately 90° in the same direction as the carrying member. The result is that in the transfer region they are directed approximately perpendicular to their rotational path. At the same time, the retaining devices or clamps are moved toward the front with respect to the carrying member, as seen in the direction of rotation. This brings the products into abutment against, and presses them onto, a printed product which is deposited in a straddling manner on a saddle-like rest of the processing device. In this device, it is absolutely necessary that in the transfer region the products move at essentially the same speed as the retaining devices or grippers. This considerably restricts the possible different ways of presenting the products at the delivery location.

Therefore, it is an object of the present invention to provide an apparatus for feeding sheet-like products to a processing device for printed products, which apparatus, even with a high processing capacity, permits the processing of a vast range of types of products along with careful handling.

SUMMARY OF THE INVENTION

This and other objects are achieved according to the invention, in an apparatus with carrying arms and linking members, by which clamps arranged on rotational elements, can be controlled separately from one another. The pivot movement of the clamp is not coupled rigidly to the movement of the carrying arms. The pivot movement of the clamps can thus be controlled independently even of the movement of the carrying arm. This permits movement of the clamps in the direction of rotation relative to the rotational elements, since it is possible to control the pivot position of the clamps independently.

This provides advantages, in particular, when receiving and discharging the products. This arrangement is also advantageous when the products are to be guided past a further processing station, in a defined position. The apparatus according to the invention permits the processing of sheet-like products in a vast range of types and sizes. For example, these may be credit cards, postcards, single-leaf and multiple-leaf printed products such as magazines and brochures, and samples of goods and CDs packed in cases.

A particularly preferred embodiment of the apparatus according to the invention uses a control device, at a delivery location to move the carrying arm in a direction counter to the direction of rotation in order to reduce the relative speed between the clamp and the product to be seized. This arrangement permits extremely careful handling of the products when receiving them at the delivery location. The low relative speed between clamp and product, even with a high speed of the rotational elements, permits a vast range of ways of receiving products. It is also particularly advantageous in the receiving of products which are at a standstill, as seen in the direction of rotation.

BRIEF DESCRIPTION OF THE DRAWINGS

The present invention will now be explained in more detail with reference to an exemplary embodiment represented schematically in the following drawings.

DETAILED DESCRIPTION OF THE PRESENTLY PREFERRED EMBODIMENTS

Figure 1:
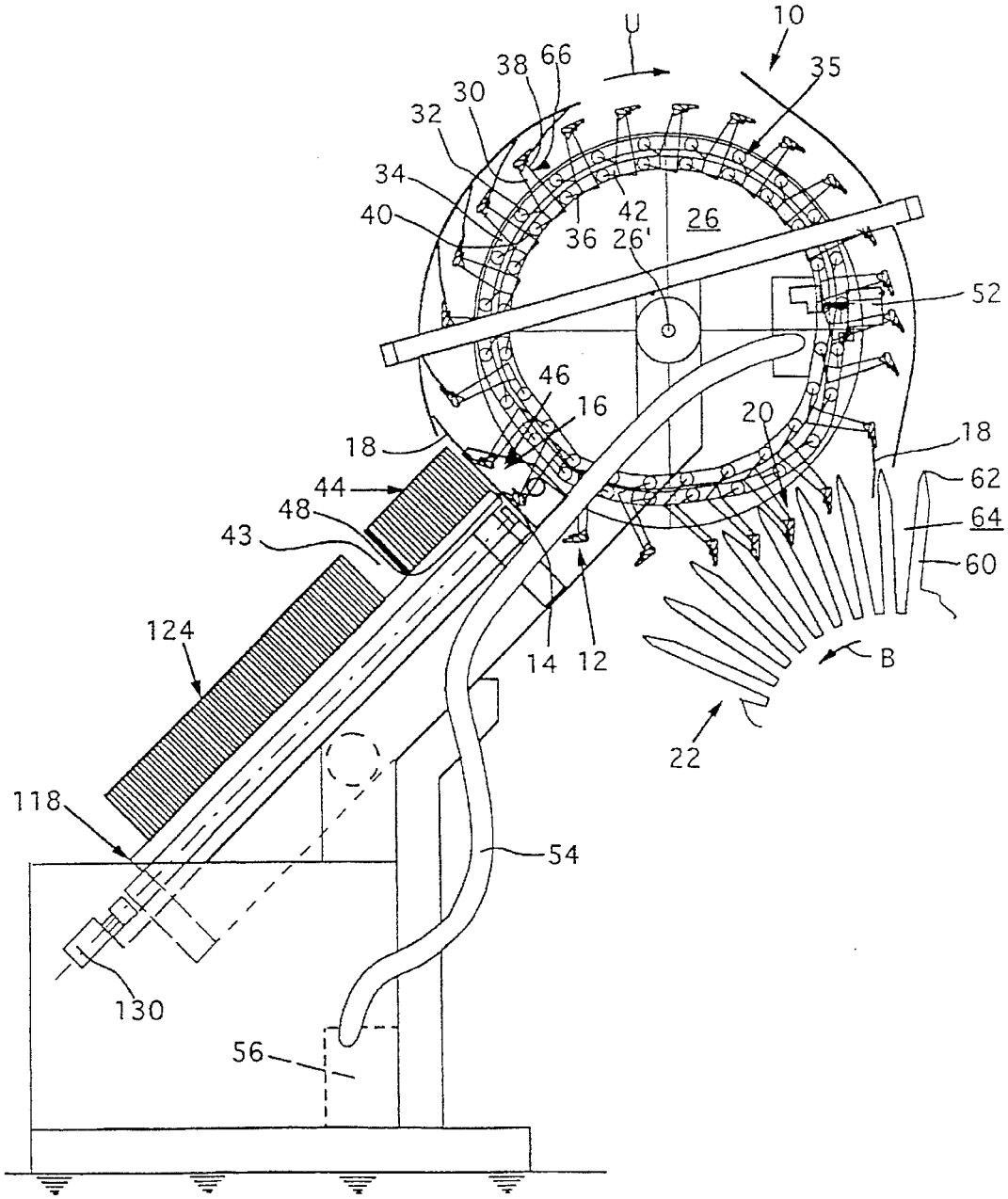
FIG. 1 shows, in elevation, an apparatus, according to a preferred embodiment of the invention, for feeding sheet-like products from a magazine to a processing device for printed products.
Figure 2:
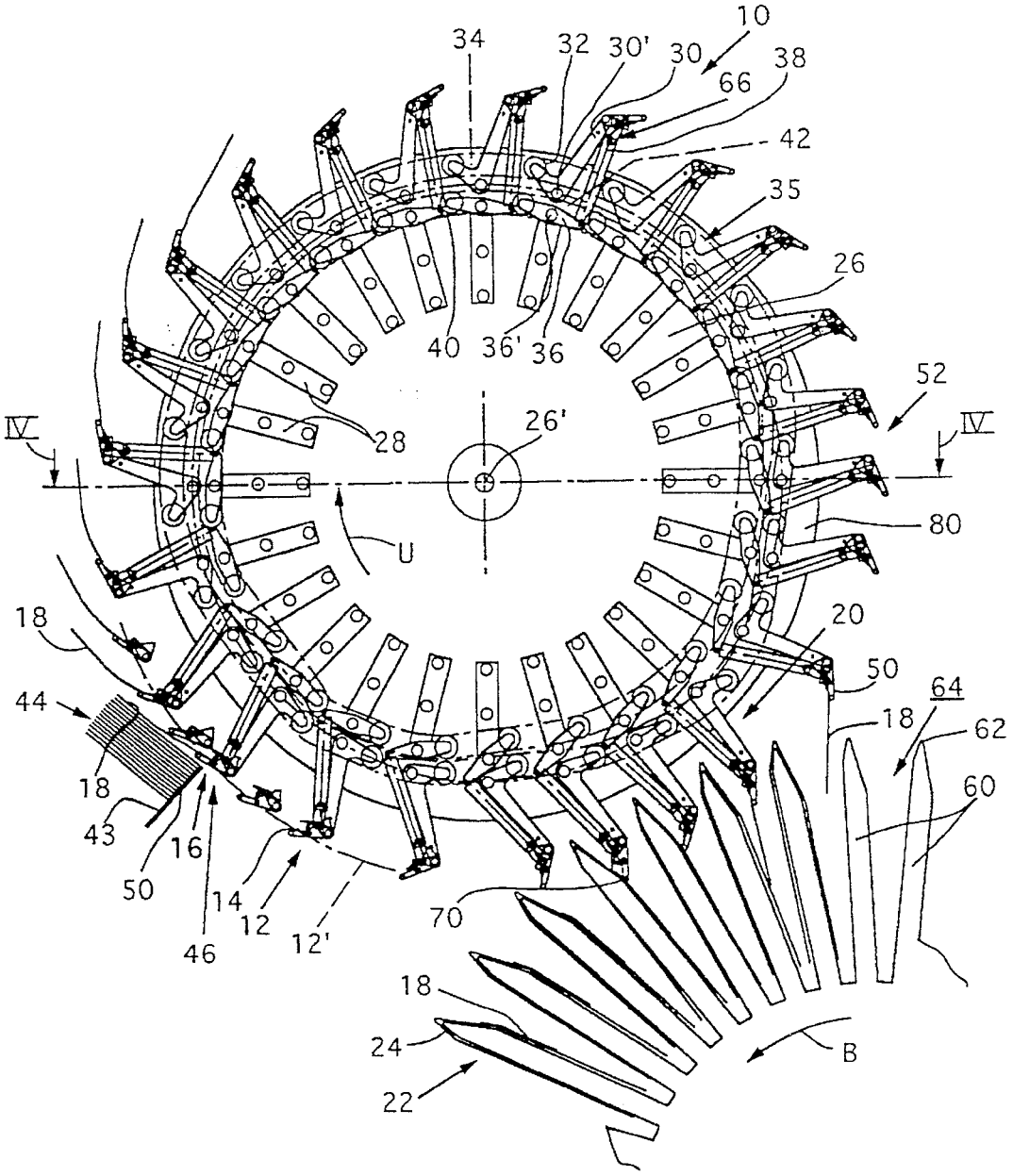
FIG. 2 shows, on an enlarged scale, part of FIG. 1.

Referring now to the drawings, FIGS. 1 and 2 show an apparatus which includes a conveying device 10 with controllable clamps 12. Each of the clamps 12 seizes, by means of its mouth 14, one product 18 at a delivery location 16. The clamps 12 then transport the product 12, in the direction of rotation U, to a transfer region 20 in which the products 18 are discharged to a processing device 22 for printed products 24.

A circular carrying disk 26 is continuously driven in the direction of rotation U about its axis of rotation 26'. Fastened on the carrying disk 26, at regular intervals along the circumference, are carrier-like rotational elements 28 which project radially outward beyond the carrying disk 26. On each rotational element 28, a carrying arm 30 is articulated about an articulation spindle 30' on an axis parallel to the axis of rotation 26'. The carrying arm pivotably bears a clamp 12 at its radially outer end. As can be seen best in FIG. 3, the carrying arm 30 is designed as a two-armed angular lever. A follow-on roller 32 is mounted freely rotatably at the end of the angular lever which is directed away from the clamp 12. The follow-on roller 32 interacts with a first slotted-guide path 34 which runs around the carrying disk 26 and belongs to a control device 35. Upon rotation of the rotational elements 28 along their circular rotational path, the carrying arm 30 is pivoted about the articulation spindle 30', by the slotted-guide control, in the direction of rotation U and counter thereto.

A two-armed control lever 36 is mounted on a further articulation spindle 36. The further articulation spindle 36' is parallel to the articulation spindle 30' and is arranged further inward in the radial direction with respect to the articulation spindle 30'. The two-armed control lever 36 is also connected to the clamp 12 via a connecting rod 38. A control roller 40 is rotatably mounted at the end of the control lever 36 which is directed away from the connecting rod 38. The control roller 40 interacts with a second slotted-guide path 42, of the control device 35, which also runs around the control disk 26. By means of this slotted-guide control, in the course of the rotation of the rotational element 28, the pivot position of the clamp 12 is controlled and, as is explained in more detail below, the mouth 14 of the clamp 12 is opened.

The end of an oblique magazine shaft 43 which receives a supply stack 44 of products 18 is arranged at the delivery location 16. The longitudinal direction of the magazine shaft 43 runs approximately radially with respect to the axis of rotation 26'. Also located at the delivery location 16 is a sucker arrangement 46. The suction head of the sucker arrangement seizes the uppermost product of the obliquely arranged supply stack 44 adjacent to the rear edge 50 (as seen in the direction of rotation U). The suction head raises the product from the supply stack 44 and moves it into the movement path 12' of the clamps 12. The product 18 is then seized at the trailing rear edge 50 (as seen in the direction of rotation U) by the forwardly directed mouth 14 of the clamp 12 and held fixedly for transporting it further. Suitable sucker arrangements 46 for this purpose are disclosed, for example, in U.S. Pat. No. 4,279,412 and the corresponding CH-A-626589, in U.S. Pat. No. 5,042,792 and the corresponding EP-A-0368009 and in U.S. patent application No. 08/007,536 and the corresponding EP-A-0553455.

As shown in FIG. 1, an adhesive-applying device 52 is arranged between the delivery location 16 and the transfer region 20, as seen in the direction of rotation U. The adhesive-applying device is connected, by a hose 54, to an adhesive-preparing device 56. The adhesive-applying device applies an adhesive coating onto each product 18 which is transported past by the clamps 12.

The processing device 22 includes wall elements 60 which are driven in rotation in the movement direction B, and run perpendicular to this movement direction B. At the outer end of the wall elements 60 which is directed towards the conveying device 10, the wall elements 60 form saddle-like rests 62 for receiving folded printed products 24 in a straddling manner. Two adjacent wall elements 60 delimit in each case one pocket-like receiving part 64 into which there may be introduced products 24 which are to be processed. Processing devices of this type are described in the U.S. Pat. Nos. 5,324,014, 5,292,110, 5,052,667, 5,052,666 and 4,981,291 and the corresponding EP publications EP-A-0550828, 0510525, 0341425, 0341424 and 0341423. For construction and mode of functioning of the processing device 22, reference to these specifications. The drive of the processing device 22 is synchronized with the drive of the conveying device 10. The result is that a clamp 12 engages, between two wall elements 60, into a receiving part 64 in the transfer region 20 in each case.

As can be seen best in FIGS. 1 and 2, the carrying arms 30 and the linking members 66, formed by the control levers 36 and connecting rods 38, are controlled such that the clamps 12 assume the position and speed adapted to requirements at the delivery location 16, at the adhesive-applying device 52 and to the transfer of the products 18 to the processing device 22.

Figure 3:
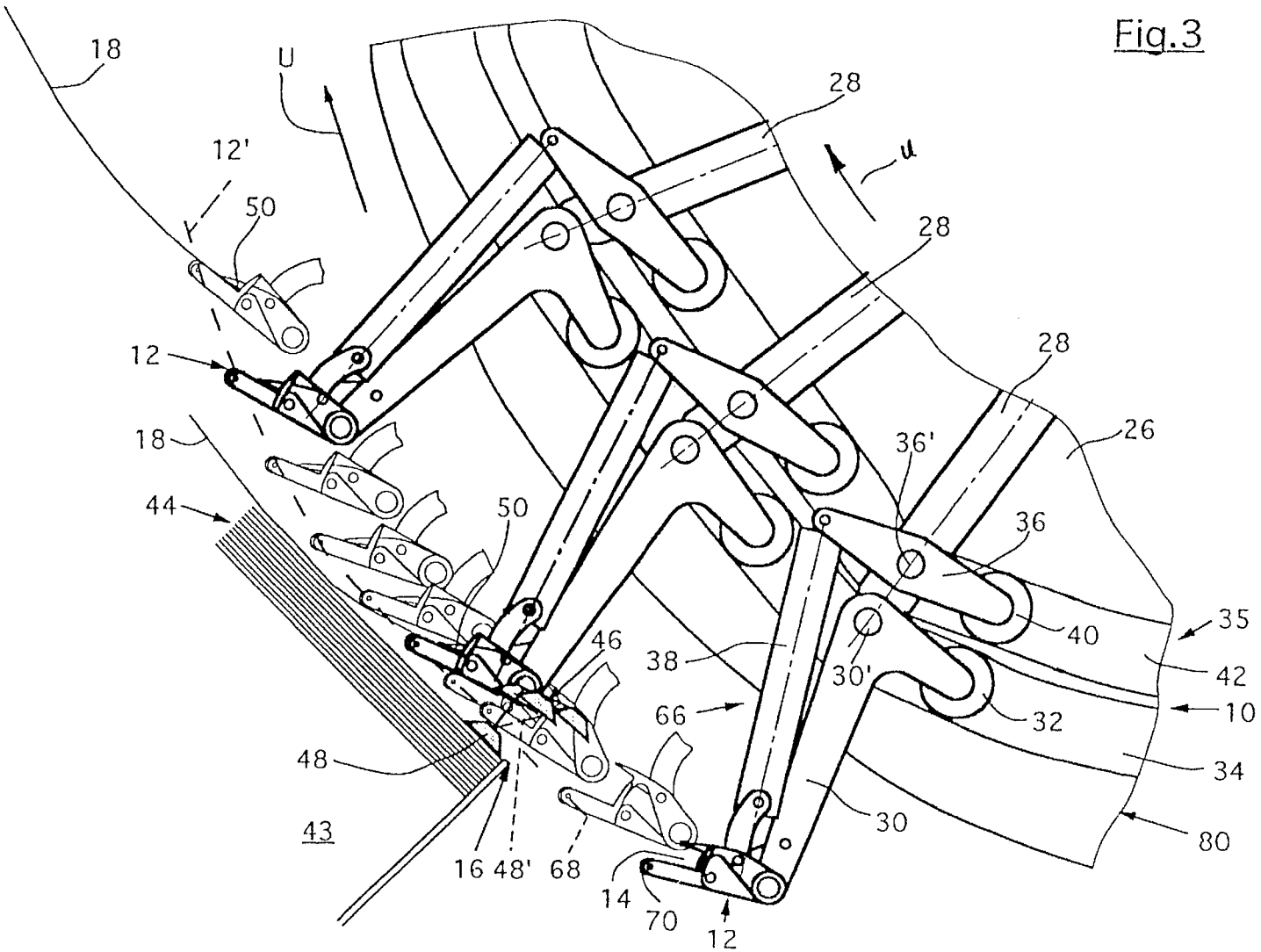
FIG. 3 shows, on an enlarged scale with respect to FIGS. 1 and 2, part of the apparatus, shown in FIGS. 1 and 2, upon receiving a product at the delivery location, at different points in time.

Shown in FIGS. 1 and 2 are the positions of the clamps 12 which they assume at a specific point in time of an operating cycle. In other words, after one operating cycle, each clamp 12 assumes that position in which the preceding clamp 12, as seen in the direction of rotation, is shown. For that clamp 12 which, at the delivery location 16, runs onto a product 18 with its mouth 14 open, FIG. 2 also shows those positions which it has assumed half a cycle earlier and which it will assume half a cycle later. Shown in FIG. 3 is the movement of the clamps 12, in the direction of rotation U, first of all in three third-steps and then in five quarter-steps of a cycle. It can be seen from this that, between the transfer region 20 and the delivery location 16, the carrying arm 30 is pivoted forward, about the articulation spindle 30', in the clockwise direction, i.e. in the direction of rotation U. Upon running of the clamp 12 onto the delivery location 16 and upon running past the delivery location 16 while seizing a product 18, the carrying arm 30 is pivoted backward in the counterclockwise direction, counter to the direction of rotation U. By virtue of this backward pivoting, the speed of the clamp 12 is reduced with respect to the speed which it would have if the carrying arm 30 were not pivoted. It can further be seen that the clamp 12, before reaching the delivery location 16, is pivoted, about its articulation on the carrying member 30, in the clockwise direction into an end position in which it runs onto the delivery location 16 in the open state.

After a product 18 has been received until approximately the level of the axis of rotation 26', the carrying arms 30 are guided forward again in the direction of rotation U, as can be seen from the large spacings between the clamps 12. As is shown in FIG. 3 by the straight line 68 shown in a chain-dotted line, the clamps 12, after the mouth 14 has been closed, are pivoted in the counterclockwise direction. The pivoting is such that, by means of their leading free end, the clamps 12 run essentially along the straight line 68, which runs approximately at right angles to the longitudinal direction of the magazine shaft 43 and thus essentially parallel to the products 18 of the supply stack 44. Following this straight part 68 of the movement path 12', the clamps 12, until they have reached approximately the level of the axis of rotation 26', are pivoted back, in a clockwise direction, approximately into their end position.

Upon running through the upper half of the movement path 12', the clamps 12 retain their position with respect to the carrying disk 26 and thus the rotational elements 28.

As is shown with reference to the clamps 12 located at the adhesive-applying device 52, the clamps, upon running past the adhesive-applying device 52, are moved at reduced speed. This is achieved by pivoting the carrying arms 36 in the counterclockwise direction. At the same time, the linking member 66 is activated such that the clamps 12, in this arrangement, assume mutually parallel positions. This gains time for the application of adhesive and achieves a uniform application.

In order to introduce the products 18 into the receiving part 64 of the processing device 22, the carrying arms 30 are pivoted forward in the clockwise direction out of their rear end position, as seen in the direction of rotation U, which they assume after having run past the adhesive-applying device 52. At the same time, the clamps 12 are pivoted in the counterclockwise direction. This movement ensures that the products 18 are introduced centrally into the receiving part 64 in a reliable manner. The respective clamp 12 is then pivoted in the clockwise direction, with the result that the product 18 comes into abutment against the printed product 24 which is deposited in a straddling manner on the leading wall element 60, as seen in the movement direction B and in the direction of rotation U. As is described below, in this arrangement, the clamp 12 is opened and, upon displacement out of the receiving part 64, presses the product 18, with its drive roller 70, onto the printed product 24. This results in a high-quality adhesive connection. Of course, in this arrangement, the position of the carrying arm 30 is also controlled such that optimum pressing-on takes place.

How the control of the carrying arm 30 and of the linking member 66 specifically takes place can be understood in detail by following the slotted-guide paths 34 and 42. Of course, by changing the shape of the first slotted-guide path 34 and/or second slotted-guide path 42, control of the clamps 12 which is adapted to specific requirements can be achieved.

Figure 4:
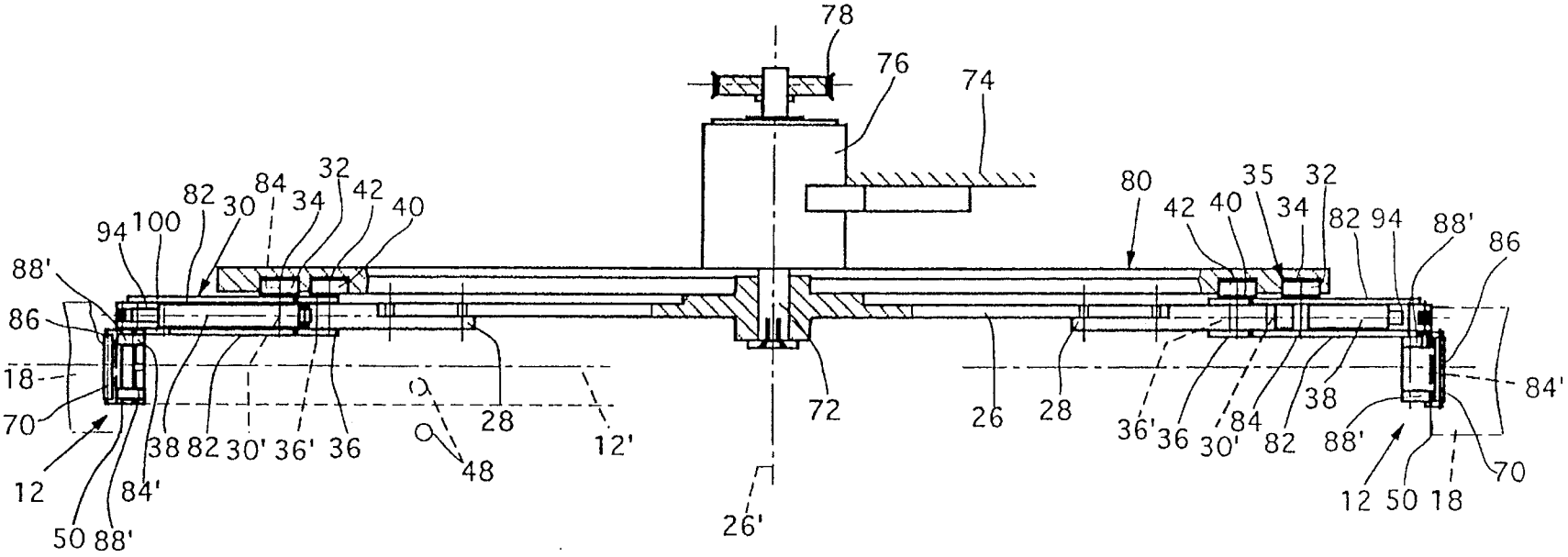
FIG. 4 shows a section along line IV—IV of FIG. 2.

As shown in FIGS. 3 and 4, the clamps 12 are supported only on one side. This has the advantage that the suction head 48 can be arranged in the vicinity of the movement path 12' of the clamps 12. This is advantageous, in particular, for the processing of small products 18, such as credit cards, or indeed making this possible in the first place. Furthermore, it is also contemplated, as shown in FIG. 4 by the suction head 48 shown in broken lines, to arrange the suction head, as seen in the direction of the axis of rotation 26', in a region in which the clamps 12 rotate. In this case, the path 48' of the suction head 48 is configured such that it bypasses in each case one clamp 12. In FIG. 3, the suction head 48 is represented at four different points in time during an operating cycle in which it rotates in the direction of the arrow along the triangular path 48'.

As can be seen in FIG. 4, the carrying disk 26 is seated in a rotationally fixed manner on a drive shaft 72. The drive shaft 72 is mounted on a bearing block 76 which is fastened on the framework 74. Via a toothed-belt drive 78, the drive shaft 72 is connected to a drive unit (not shown) which is synchronized with the processing device 22. The two groove-like slotted-guide paths 34 and 42 are made in a control ring 80 which is also supported on the framework 74. With respect to the carrying disk 26, the control ring 80 is arranged on the side of the bearing block 76 and, as seen in the radial direction, runs outside the carrying disk 26.

Figure 6:
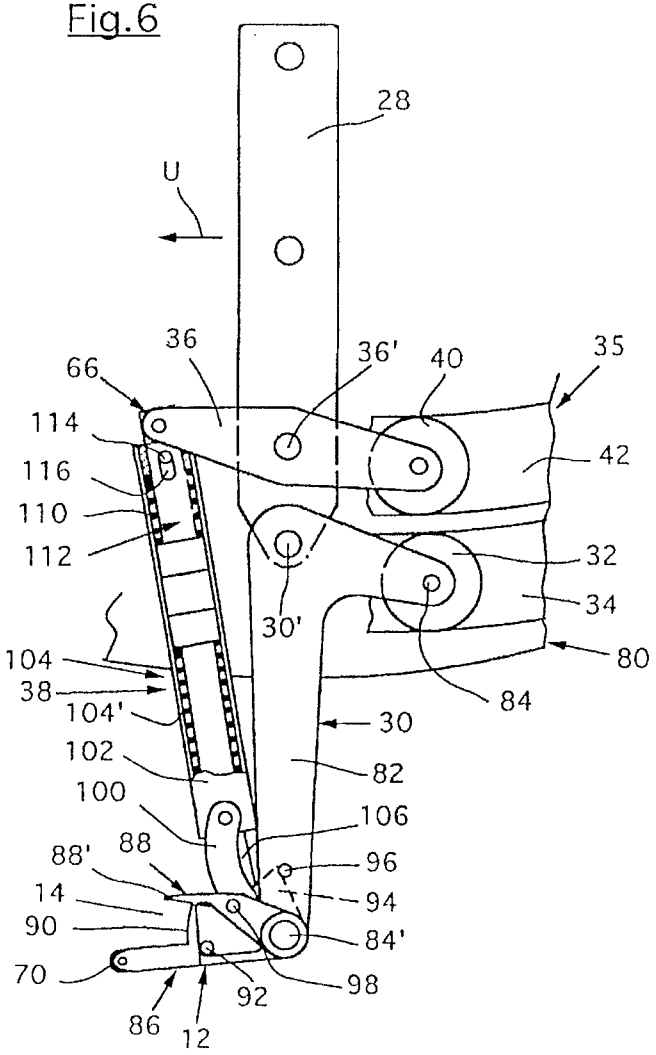
FIG. 6 shows, in the same representation as FIG. 5, the clamp in the open position.
Figure 5:
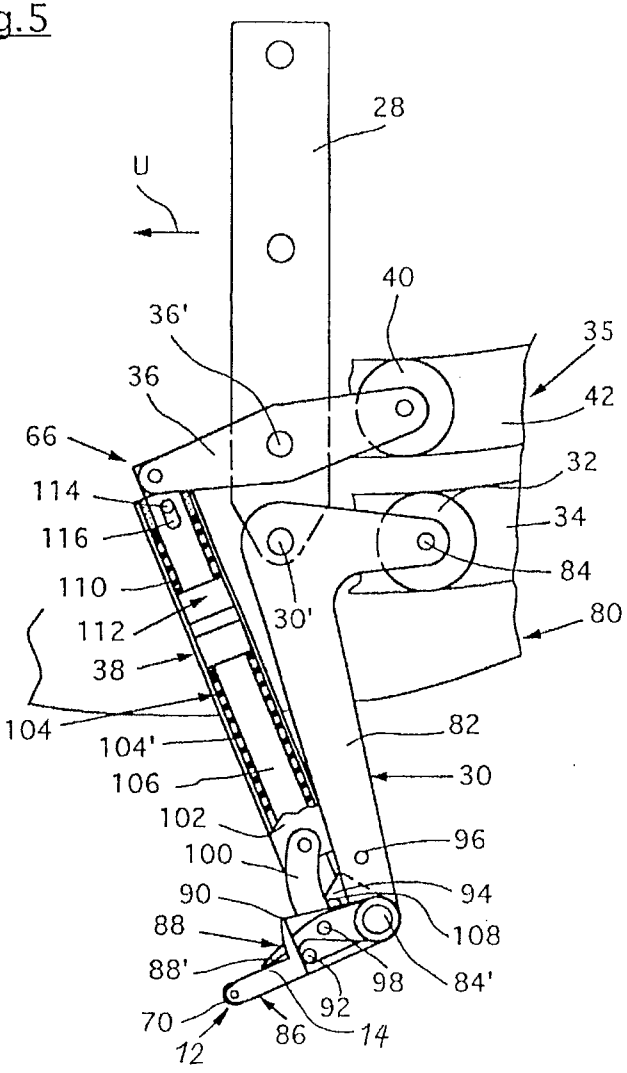
FIG. 5 shows, in elevation and partly in section, a clamp with carrying arm and linking member, in the closed position of the clamp.

The construction and mode of functioning of the clamps 12 will now be explained with reference to FIGS. 4–6. The carrying arm 30 comprises two identical carrying-arm parts 82 which are each arranged on one side of the rotation element 28 and are mounted on the articulation spindle 30'. At both ends, the carrying-arm parts 82 are connected to one another via bearing shafts 84, 84'. The follow-on roller 32 is mounted on the first bearing shaft 84. A first clamping jaw 86 and a second clamping jaw 88 of the clamp 12 are mounted on the second bearing shaft 84'. The first clamping jaw 86, which is located on the outside with respect to the axis of rotation 26' (as seen in the radial direction) is designed in a plate-like manner. The clamping jaw 86 includes the press-on roller 70 at its leading free end (as seen in the direction of rotation U). The clamping jaw 86 is provided, in the central region, with a carry-along stop 90 which forms the inner end of the mouth 14. At the delivery location 16, the open clamp 12, enclosing a product 18 by means of the carry-along stop 90 and by means of the first and second clamping jaw 86, 88, runs onto the rear edge 50 of the product 18 and carries it along in the direction of rotation U. Via a connecting pin 92 running parallel to the bearing shaft 84', the first clamping jaw 86 is fixedly connected to a triangular stop element 94. The stop element 94 is seated freely rotatably on the bearing shaft 84', between the two carrying-arm parts 82. The stop element 94 interacts with a stop pin 96 which connects the two carrying-arm parts 82 to one another. Upon abutment of the stop element 94 against the stop pin 96, the first clamping jaw 86 is located in its end position shown in FIG. 6. In this position it runs approximately at right angles to the associated lever arm of the carrying arm 30. The clamp 12 can be moved out of this position only in the counterclockwise direction.

As can be seen in FIG. 4, the second clamping jaw 88 comprises two tongue-like clamping-jaw parts 88'. The clamping-jaw parts 88' are connected to one another in a rotationally fixed manner and, in comparison with the first clamping jaw 86, project to a considerably lesser extent beyond the stop element 94. The latter, of course, includes cutouts in which the clamping-jaw parts 88' can pivot freely. The second clamping jaw 88 is articulated, by means of a further connecting pin 98 which also runs parallel to the bearing shaft 84', to a lug 100 which is articulated, at the other end, to a tube 102 of the connecting rod 38. Arranged in this tube 102 is a compression spring 104' which forms the closure spring 104 for the clamping jaws 86, 88. The compression spring 164 is supported, on the one hand, at the clamp-side end of the tube 102 and, on the other hand, on a pull rod 106. The pull rod 106 runs, in the interior of the tube 102, through the compression spring 104' and is connected to the stop element 94 by means of an articulation pin 108. The compression spring 104' is prestressed and acts on the clamping jaws 86, 88 in the closure direction.

By means of its end directed toward the control lever 36, the tube 102 can be articulated directly on the control lever 36, which is also designed as a double lever. A form of articulation via spring element 110 designed as a compression spring is, however, represented in FIGS. 5 and 6. The spring element is prestressed more than the closure spring 104. The spring element is arranged in the interior of the tube 102 and is supported, at one end, on the tube and, at the other end, on a rod-like connecting element 112. The connecting element 112 runs through the spring element 110, and is articulated on the control lever 36. Its displacement, in the longitudinal direction of the tube 102, is delimited by a delimiting pin 114 which engages through a slot-like transverse through-passage 116 in the connecting element 112 and is fastened on the tube 102. As a result of the force of the spring element 110 being greater than that of the closure spring 104, the tube 102, under normal conditions, assumes, with respect to the connecting element 112, the position shown in FIGS. 5 and 6. In this position the control-lever-side end of the transverse through-passage 116 butts against the delimiting pin 114.

As a result of the prestressing of the closure spring 104 and of the spring element 110, the clamp 12, upon rotation of the control lever 36, is pivoted, with the latter, in the same direction. If, upon pivoting of the control lever 36 in the clockwise direction, the stop element 94 then comes into abutment against the stop pin 96, the first clamping jaw 86 is prevented from further pivoting-along. This results in the opening of the clamp mouth 14, with simultaneous further stressing of the closure spring 104. If, when the clamp 12 is opened, the control lever 36 is pivoted in the counterclockwise direction, the stop element 94, as a result of the force of the closure spring 104, remains in abutment against the stop pin 96 until the second clamping jaw 88 butts against the first clamping jaw 86 and/or the product 18 engaging into the mouth 14 is clamped in between the clamping jaws 86 and 88. Thereafter, the first clamping jaw 86 is pivoted together with the second clamping jaw 88.

As can be seen, in particular, in FIG. 2, the clamp 12, upon discharge of the products 18 to the processing device 22, is moved toward the wall element 60. This results in the first clamping jaw 86 being supported, by means of its press-on roller 70, against said wall element 60 via the product 18 and printed product 24. The position of the second clamping jaw 88 is, then, predetermined by the second slotted-guide path 42 and the linking member 66. Consequently, pivoting of the first clamping jaw 86 in the counterclockwise direction leads to the mouth 14 of the clamp 12 being opened and the product 18 being released. Under the force of the closure spring 104, the press-on roller 70 butts against the product 18. Upon displacement of the clamp 12 out of the receiving part 64, the press-on roller 70 presses the product onto the printed product 24, rolling in the process. As soon as the press-on roller 70 is no longer supported by the processing device 22, the mouth 14 is closed, the first clamping jaw 68, under the force of the closure spring 104, being pivoted into abutment against the second clamping jaw 88.

It is conceivable, then, that, in particular during the processing of thick and possibly inflexible products 18 and printed products 24, the first clamping jaw 86 is pivoted, with respect to the second clamping jaw 88, beyond an amount which can be taken up by the closure spring 104. In order to avoid damage to the products 18 and printed products 24 and to the conveying device 10 and processing device 22 in this arrangement, the tube 102 is connected to the control lever 36 via the spring element 110, which, in this case, takes up the excess displacement.

Figure 8:
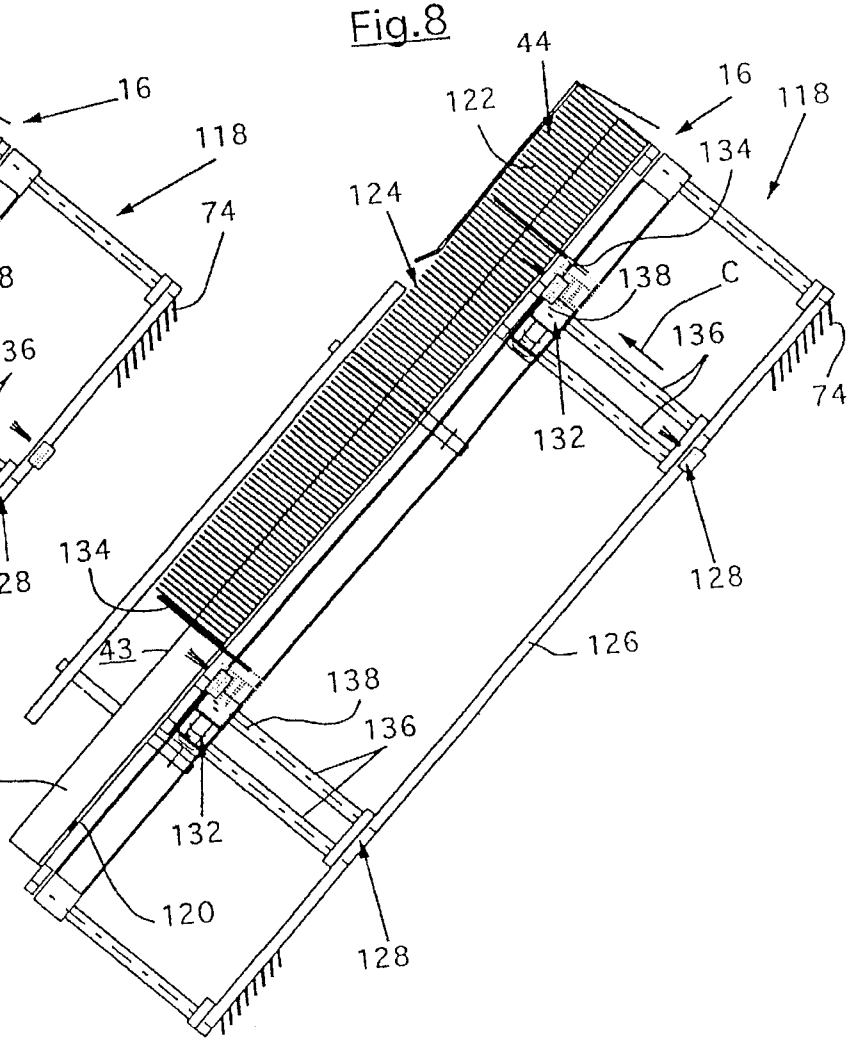
FIG. 8 shows, in the same representation as FIG. 7, the filled magazine device.
Figure 7:
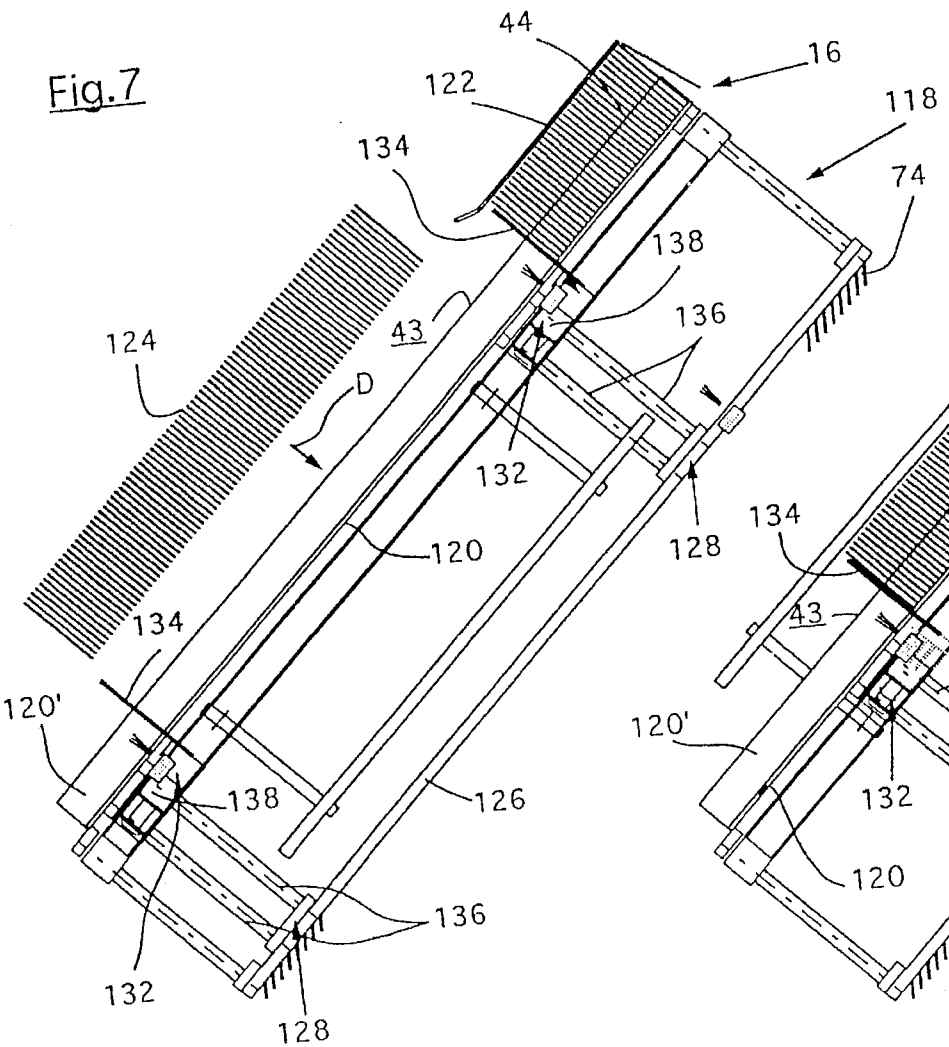
FIG. 7 shows, in elevation, the magazine device upon introduction of a replacement stack of products during the reduction of the supply at the delivery location.

FIGS. 7 and 8 show, on an enlarged scale, the magazine device 118 which is represented in FIG. 1 and is likewise arranged on the framework 74. It includes the magazine shaft 43 which is inclined with respect to the vertical and of which the top discharge end is arranged at the delivery location 16. The magazine shaft 43 is delimited, over its entire length, by base and side-wall profiles 120, 120' running in its longitudinal direction and, in its end region directed towards the delivery location 16, by means of a ceiling element 122. Between the ceiling element 122 and the bottom end of the magazine shaft 43, the latter is accessible from above for the introduction of a replacement stack 124.

Offset rails 126 run parallel to the magazine shaft 43 and are arranged beneath the same. Guided on the laterally offset rails 126 are two carriages 128 which, driven by means of in each case one spindle drive 130 (FIG. 1), can be displaced past one another along the magazine shaft 43. On each carriage 128, a slide 132, on which there is fastened a supporting tongue 134 projecting in the direction towards the magazine shaft 43, can be displaced on guide rods 136 in a direction at right angles to the rails 126. The result is that the supporting tongue 134 can be moved into the magazine shaft 43 in the direction of the arrow C and out of the magazine shaft 43 in the opposite direction. Each carriage 128 is assigned a drive member 138 for the respective slide 132.

For the introduction of a first supply stack 44 into the magazine shaft 43, the two carriages 128 are located in their bottom end position remote from the delivery location 16, the supporting tongues 134 having been moved into the magazine shaft 43. The supply stack 43 is then introduced into the magazine shaft 43 in the direction of the arrow D. Subsequently, one carriage 128 is driven in the direction towards the delivery location 16 until the uppermost product 18 has reached said location. As the stack is reduced at the delivery location 16, the position of the relevant carriage 128 is then automatically readjusted. The result is that the upper end of the supply stack 44 is always located at the delivery location 16. After a partial reduction of the supply stack 44, a replacement stack 124 is then introduced into the magazine shaft 43, as shown by the arrow D. The carriage 128 which is still located at the bottom end is then driven in the direction toward the delivery location 16 until the upper end of the replacement stack 124 butts against the supporting tongue 134 of the carriage 128 displacing the supply stack 44. This is shown in FIG. 8. The supporting tongue 134 can then be drawn back out of the magazine shaft 43 counter to the direction of the arrow C, whereupon all the products 18 in the magazine shaft 43 are advanced by the supporting tongue 134 of the other carriage 128. The carriage 128 with the supporting tongue 134 which has been drawn back out of the magazine shaft 43 is then moved back again to the bottom end of the magazine shaft 43. The relevant supporting tongue 134 is then pushed into the magazine shaft 43 again. The magazine shaft is then ready to receive a further replacement stack 124.

By means of this magazine device 118 with a single magazine shaft 43, it is ensured that products 18 are presented at the delivery location 16 in an uninterrupted manner.

The magazine device 118 shown in FIGS. 1, 7 and 8 may be replaced by a device such as that disclosed in U.S. patent application No. 08/409,799. This device is also suitable for presenting products 18 at the delivery location 16 in an uninterrupted manner and for interacting with the conveying device 10.

The conveying device 10 may, of course, also exhibit clamps 12 of a different design.

The foregoing description of the preferred embodiments of the present invention has been presented for purposes of illustration and description. The preferred embodiments are not intended to be exhaustive or to limit the invention to the precise forms disclosed, and obviously many modifications and variations are possible in light of the above teachings. It is intended that the scope of the invention be defined by the following claims, including all equivalents.

I claim:

1. An apparatus for feeding sheet-like products to a processing device for printed products, comprising:

a plurality of rotational elements driven in rotation along a continuous rotational path and spaced apart, one behind the other, in the direction of rotation;

a plurality of clamps arranged to seize the products as the clamps run past a delivery location and to transport the products to a transfer region, each clamp being articulated, to both a carrying arm and a linking member, both the carrying arm and the linking member being articulate to one of the rotational elements; and a control device for separately controlling the carrying arm and the linking member so as to pivot the clamps about an articulation axis on the carrying arm but independently of movement of the carrying arm.

2. The apparatus as claimed in claim 1, wherein the control device, at the delivery location, moves the carrying arm in a direction counter to the direction of rotation in order to reduce the relative speed between the clamp and the product to be seized.

3. The apparatus as claimed in claim 2, comprising:

a magazine adapted to receive a supply of products in a stack-like manner, the magazine arranged adjacent to the delivery location;

a sucker arrangement acting on the outermost product of the supply to raise the product from the supply and to displace it into a movement path of the clamps; and the control device controlling the carrying arm and the linking member such that the relevant clamp which is at the delivery location and is in that portion of the movement path which adjoins the delivery location, in the direction of rotation, moves essentially along a straight line.

4. The apparatus as claimed in claim 3, wherein the straight line runs approximately perpendicular to a longitudinal direction of the magazine.

5. The apparatus as claimed in claim 2, wherein the rotational elements are arranged on a rotationally driven wheel-like carrying element, whereby the rotational path of the rotational elements is circular.

6. The apparatus as claimed in claim 1 comprising an adhesive-preparing device arranged adjacent to the movement path of the clamps and wherein, as seen in the direction of rotation, downstream of the delivery location and upstream of the transfer region, the control device controls the carrying arm and the linking member such that the clamps, at the adhesive-applying device, move past at a reduced speed and in an approximately mutually parallel pivot position.

7. The apparatus as claimed in claim 1 further comprising a processing device, the processing device comprising:

a plurality of wall elements which are driven in rotation, are spaced apart one behind the other in the movement direction and which receive printed products, the movement direction of the wall elements, in the transfer region, being directed approximately in the same direction as the direction of rotation; and wherein each clamp engages, in the transfer region, between two adjacent wall elements in order to discharge a product, and the control device controls the carrying arm and the linking member such that a jaw of the clamp is directed approximately parallel with respect to said wall elements to introduce a product between the wall elements.

8. The apparatus as claimed in claim 7, wherein the wall elements form saddle-like rests onto which printed products are deposited.

9. The apparatus as claimed in claim 7, wherein the wall elements form pocket-like receiving parts into which printed products are introduced.

10. The apparatus as claimed in claim 7, wherein the control device controls the carrying arm and the linking member such that a clamp which is located between the wall elements moves toward a wall element to lay the product onto one of the wall elements and a printed product butting against said wall element.

11. The apparatus as claimed in claim 1, wherein the linking member includes a connecting rod which is articulated, at one end, on the clamp and, at the other end, on a control lever, the control lever and the carrying arm are mounted, about spindles which run perpendicular to the direction of rotation, on the rotation element, and the control device includes two control elements.

12. The apparatus as claimed in claim 11, wherein the two control elements comprise slotted-guide paths running along the rotational path, each slotted-guide path interacting with a follower connected to the carrying arm and to the linking member, respectively.

13. The apparatus as claimed in claim 11, wherein:

for each clamp, a first jaw of the clamp is mounted on the carrying arm and is connected to a stop element and a second jaw of the clamp is connected to the connecting rod;

a closure spring interacts between the jaws; and the stop element interacts with a counter-stop on the carrying arm to open the clamp.

14. The apparatus as claimed in claim 13, wherein the closure spring comprises a compression spring arranged in the direction of the connecting rod and supported on the connecting rod, by its end which is directed toward the clamp, and on a pulling element connected to the first jaw, by its end which is directed toward the control lever.

15. The apparatus as claimed in claim 14, wherein the first jaw includes, at its free end, a roller-like press-on element for pressing the product against a wall element of the processing device, and to open the clamp in order to release the product.

16. The apparatus as claimed in claim 1, wherein:

for each clamp, a first jaw of the clamp is mounted on the carrying arm and is connected to a stop element and a second jaw of the clamp is connected to the linking member;

a closure spring interacts between the jaws; and the stop element interacts with a counter-stop on the carrying arm to open the clamp.

17. The apparatus as claimed in claim 1, wherein the rotational elements are arranged on a rotationally driven wheel-like carrying element, whereby the rotational path of the rotational elements is circular.

18. The apparatus as claimed in claim 1, wherein, upon moving past the delivery location, the mouth of the clamps is directed toward the front, as seen in the direction of rotation, to seize a product at its trailing edge.

* * * * *